US009754605B1

(12) United States Patent
Chhetri

(10) Patent No.: US 9,754,605 B1
(45) Date of Patent: Sep. 5, 2017

(54) STEP-SIZE CONTROL FOR MULTI-CHANNEL ACOUSTIC ECHO CANCELLER

(71) Applicant: Amazon Technologies, Inc., Seattle, WA (US)

(72) Inventor: Amit Singh Chhetri, Santa Clara, CA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 0 days.

(21) Appl. No.: 15/177,624

(22) Filed: Jun. 9, 2016

(51) Int. Cl.

| | |
|---|---|
| ***G10L 21/0264*** | (2013.01) |
| ***H04R 3/04*** | (2006.01) |
| ***G10L 25/21*** | (2013.01) |
| ***H04S 7/00*** | (2006.01) |
| *G10L 21/0208* | (2013.01) |

(52) U.S. Cl.
CPC ..... *G10L 21/0264* (2013.01); *G10L 25/21* (2013.01); *H04R 3/04* (2013.01); *H04S 7/305* (2013.01); *G10L 2021/02082* (2013.01)

(58) Field of Classification Search
CPC ..... H04M 3/002; H04M 1/20; G10L 2021/02163; G10L 2021/02166; G10L 21/0264; G10L 19/22; G10L 25/12; G10L 25/60; G10L 25/90; H03H 21/0012; H03H 2021/0078; H03H 2021/0089; H03H 2021/0061
See application file for complete search history.

(56) References Cited

U.S. PATENT DOCUMENTS

| | | | | |
|---|---|---|---|---|
| 5,329,472 | A * | 7/1994 | Sugiyama | H03H 21/0012 708/322 |
| 2008/0101622 | A1* | 5/2008 | Sugiyama | H04M 9/082 381/66 |
| 2009/0181637 | A1* | 7/2009 | Mueller-Weinfurtner | H04L 25/0202 455/334 |
| 2015/0063581 | A1* | 3/2015 | Tani | G10K 11/178 381/71.2 |
| 2015/0104030 | A1* | 4/2015 | Ueno | G10K 11/178 381/71.4 |

* cited by examiner

*Primary Examiner* — Mohammad Islam
(74) *Attorney, Agent, or Firm* — Pierce Atwood LLP

(57) ABSTRACT

A multi-channel acoustic echo cancellation (AEC) system that includes a step-size controller that dynamically determines a step-size value for each channel and each tone index on a frame-by-frame basis. The system determines the step-size value based on a normalized squared cross-correlation (NSCC) between an estimated echo signal and an error signal, allowing the AEC system to converge quickly when an acoustic room response changes while providing stable steady-state error by avoiding misadjustments due to noise sensitivity and/or near-end speech. The step-size value can be determined using fractional weighting that takes into account a signal strength of each channel.

20 Claims, 6 Drawing Sheets

STEP-SIZE CONTROL FOR MULTI-CHANNEL ACOUSTIC ECHO CANCELLER

BACKGROUND

In audio systems, automatic echo cancellation (AEC) refers to techniques that are used to recognize when a system has recaptured sound via a microphone after some delay that the system previously output via a speaker. Systems that provide AEC subtract a delayed version of the original audio signal from the captured audio, producing a version of the captured audio that ideally eliminates the "echo" of the original audio signal, leaving only new audio information. For example, if someone were singing karaoke into a microphone while prerecorded music is output by a loudspeaker, AEC can be used to remove any of the recorded music from the audio captured by the microphone, allowing the singer's voice to be amplified and output without also reproducing a delayed "echo" the original music. As another example, a media player that accepts voice commands via a microphone can use AEC to remove reproduced sounds corresponding to output media that are captured by the microphone, making it easier to process input voice commands.

BRIEF DESCRIPTION OF DRAWINGS

For a more complete understanding of the present disclosure, reference is now made to the following description taken in conjunction with the accompanying drawings.

DETAILED DESCRIPTION

Figure 1:
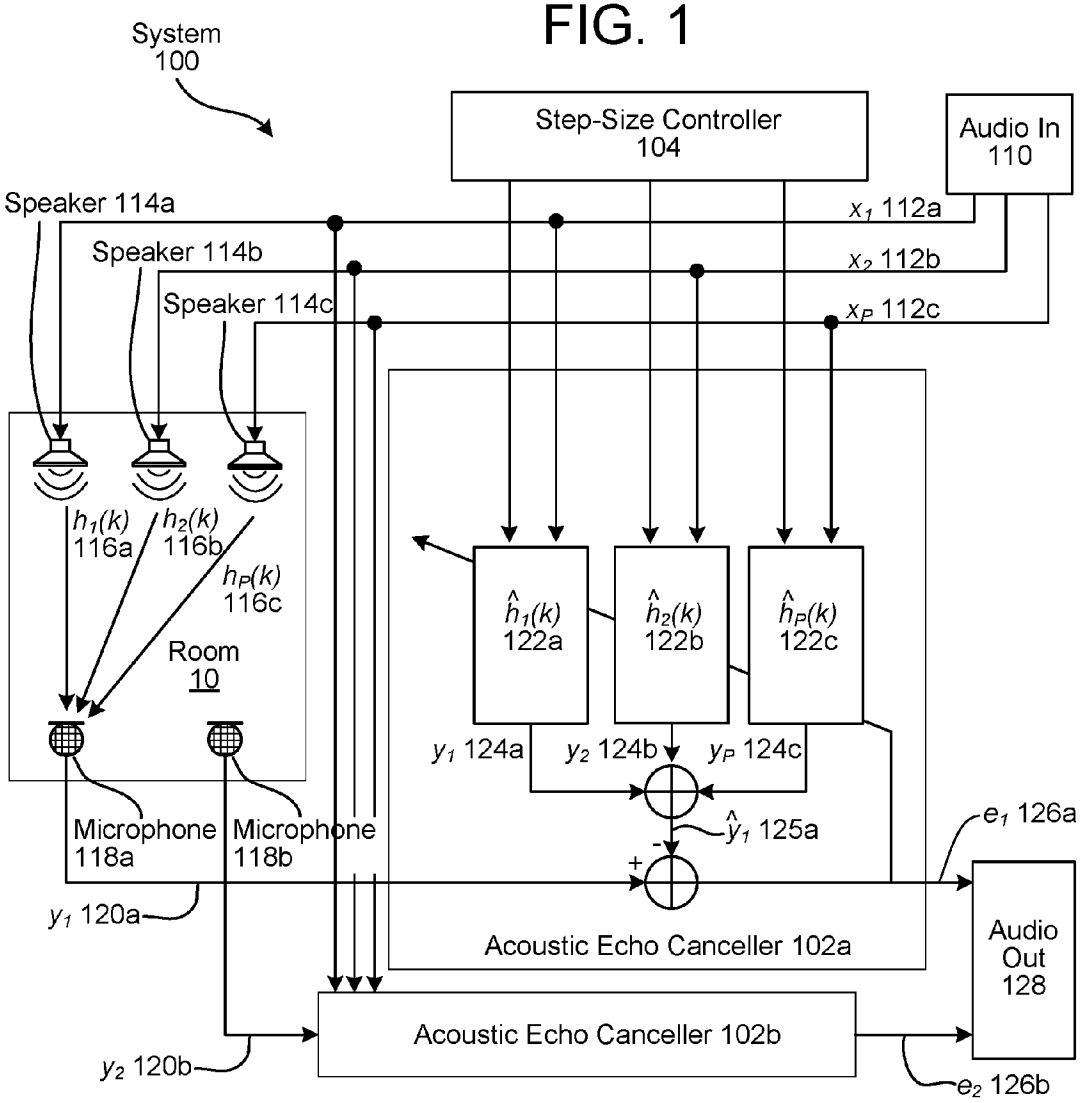
FIG. 1 illustrates an echo cancellation system that dynamically controls a step-size parameter according to embodiments of the present disclosure.

Acoustic echo cancellation (AEC) systems eliminate undesired echo due to coupling between a loudspeaker and a microphone. The main objective of AEC is to identify an acoustic impulse response in order to produce an estimate of the echo (e.g., estimated echo signal) and then subtract the estimated echo signal from the microphone signal. Many AEC systems use frequency-domain adaptive filters to estimate the echo signal. However, frequency-domain adaptive filters are highly influenced by the selection of a step-size parameter. For example, a large step-size value results in a fast convergence rate (e.g., short convergence period before the estimated echo signal matches the microphone signal) but has increased steady state error (e.g., errors when the system is stable) and is sensitive to local speech disturbance, whereas a small step-size value results in low steady state error and is less sensitive to local speech disturbance, but has a very slow convergence rate (e.g., long convergence period before the estimated echo signal matches the microphone signal). Thus, AEC systems using fixed step-sizes either prioritize a fast convergence rate or low steady state error.

Some AEC systems compromise by having variable step-size values, alternating between two or more step-size values. For example, an AEC system may determine when the signals are diverging or far apart (e.g., the estimated echo signal does not match the microphone signal and/or an error is increasing) and select a large step-size value, or determine when the signals are converging (e.g., the estimated echo signal is getting closer to the microphone signal and/or the error is decreasing) and select a small step-size value. While this compromise avoids the slow convergence rate and/or increased steady-state error of using the fixed step-size value, the AEC system must correctly identify when the signals are diverging or converging and there may be a delay when the system changes, such as when there is local speech or when an echo path changes (e.g., someone stands in front of the loudspeaker).

To improve steady-state error, reduce a sensitivity to local speech disturbance and improve a convergence rate when the system changes, devices, systems and methods are disclosed for dynamically controlling a step-size value for an adaptive filter. The step-size value may be controlled for each channel (e.g., speaker output) in a multi-channel AEC algorithm and may be individually controlled for each frequency subband (e.g., range of frequencies, referred to herein as a tone index) on a frame-by-frame basis (e.g., dynamically changing over time). The step-size value may be determined based on a scale factor that is determined using a normalized squared cross-correlation value between an overall error signal and an estimated echo signal for an individual channel. Thus, as the microphone signal and the estimated echo signal diverge, the scale factor increases to improve the convergence rate (e.g., reduce a convergence period before the estimated echo signal matches the microphone signal), and when the microphone signal and the estimated echo signal converge, the scale factor decreases to reduce the steady state error (e.g., reduce differences between the estimated echo signal and the microphone signal). The step-size value may also be determined based on a fractional step-size weighting that corresponds to a magnitude of the reference signal relative to a maximum magnitude of a plurality of reference signals. As the AEC system and the system response changes, the step-size value is dynamically changed to reduce the steady state error rate while maintaining a fast convergence rate.

FIG. 1 illustrates a high-level conceptual block diagram of echo-cancellation aspects of a multi-channel acoustic echo cancellation (AEC) system 100 in "time" domain. The system 100 may include a step-size controller 104 that controls a step-size parameter used by acoustic echo cancellers 102, such as a first acoustic echo canceller 102*a* and a second acoustic echo canceller 102*b*. For example, the step-size controller 104 may receive microphone signal(s) 120 (e.g., 120*a*), estimated echo signals 124 (e.g., 124*a*, 124*b* and 124*c*), error signal(s) 126 (e.g., 126*a*) and/or other signals generated or used by the first acoustic echo canceller 102*a* and may determine step-size values and provide the step-size values to the first acoustic echo canceller 102*a* to be used by adaptive filters included in the first acoustic echo canceller 102*a*. The step-size values may be determined for individual channels (e.g., reference signals 120) and tone indexes (e.g., frequency subbands) on a frame-by-frame basis. The first acoustic echo canceller 102*a* may use the step-size values to perform acoustic echo cancellation and generate a first error signal 126*a*, as will be discussed in greater detail below. Thus, the first acoustic echo canceller 102*a* may generate the first error signal 126*a* using first filter coefficients for the adaptive filters, the step-size controller 104 may use the first error signal 126*a* to determine a step-size value and the adaptive filters may use the step-size value to generate second filter coefficients from the first filter coefficients.

As illustrated in FIG. 1, an audio input 110 provides stereo audio "reference" signals $x_1(n)$ 112*a*, $x_2(n)$ 112*b* and $x_P(n)$ 112*c*. A first reference signal $x_1(n)$ 112*a* is transmitted to a first loudspeaker 114*a*, a second reference signal $x_2(n)$ 112*b* is transmitted to a second loudspeaker 114*b* and a third reference signal $x_P(n)$ 112*c* is transmitted to a third loudspeaker 114*c*. Each speaker outputs the received audio, and portions of the output sounds are captured by a pair of microphone 118*a* and 118*b*. While FIG. 1 illustrates two microphones 118*a*/118*b*, the disclosure is not limited thereto and the system 100 may include any number of microphones 118 without departing from the present disclosure.

The portion of the sounds output by each of the loudspeakers 114*a*/114*b*/114*c* that reaches each of the microphones 118*a*/118*b* can be characterized based on transfer functions. FIG. 1 illustrates transfer functions $h_1(n)$ 116*a*, $h_2(n)$ 116*b* and $h_P(n)$ 116*c* between the loudspeakers 114*a*/114*b*/114*c* (respectively) and the microphone 118*a*. The transfer functions 116 vary with the relative positions of the components and the acoustics of the room 10. If the position of all of the objects in a room 10 are static, the transfer functions are likewise static. Conversely, if the position of an object in the room 10 changes, the transfer functions may change.

The transfer functions (e.g., 116*a*, 116*b*, 116*v*) characterize the acoustic "impulse response" of the room 10 relative to the individual components. The impulse response, or impulse response function, of the room 10 characterizes the signal from a microphone when presented with a brief input signal (e.g., an audible noise), called an impulse. The impulse response describes the reaction of the system as a function of time. If the impulse response between each of the loudspeakers 116*a*/116*b*/116*c* is known, and the content of the reference signals $x_1(n)$ 112*a*, $x_2(n)$ 112*b* and $x_P(n)$ 112*c* output by the loudspeakers is known, then the transfer functions 116*a*, 116*b* and 116*c* can be used to estimate the actual loudspeaker-reproduced sounds that will be received by a microphone (in this case, microphone 118*a*). The microphone 118*a* converts the captured sounds into a signal $y_1(n)$ 120*a*. A second set of transfer functions is associated with the other microphone 118*b*, which converts captured sounds into a signal $y_2(n)$ 120*b*.

The "echo" signal $y_1(n)$ 120*a* contains some of the reproduced sounds from the reference signals $x_1(n)$ 112*a*, $x_2(n)$ 112*b* and $x_P(n)$ 112*c*, in addition to any additional sounds picked up in the room 10. The echo signal $y_1(n)$ 120*a* can be expressed as:

$$y_1(n)=h_1(n)*x_1(n)+h_2(n)*x_2(n)+h_P(n)*x_P(n) \quad [1]$$

where $h_1(n)$ 116*a*, $h_2(n)$ 116*b* and $h_P(n)$ 116*c* are the loudspeaker-to-microphone impulse responses in the receiving room 10, $x_1(n)$ 112*a*, $x_2(n)$ 112*b* and $x_P(n)$ 112*c* are the loudspeaker reference signals, * denotes a mathematical convolution, and "n" is an audio sample.

The acoustic echo canceller 102*a* calculates estimated transfer functions 122*a*, 122*b* and 122*c*, each of which model an acoustic echo (e.g., impulse response) between an individual loudspeaker 114 and an individual microphone 118. For example, a first estimated transfer function $\hat{h}_1(n)$ 122*a* models a first transfer function 116*a* between the first loudspeaker 114*a* and the first microphone 118*a*, a second estimated transfer function $\hat{h}_2(n)$ 122*b* models a second transfer function 116*b* between the second loudspeaker 114*b* and the first microphone 118*a*, and so on until a third estimated transfer function $\hat{h}_2(n)$ 122*c* models a third transfer function 116*c* between the third loudspeaker 114*c* and the first microphone 118*a*. These estimated transfer functions $\hat{h}_1(n)$ 122*a*, $\hat{h}_2(n)$ 122*b* and $\hat{h}_P(n)$ 122*c* are used to produce estimated echo signals $y_1(n)$ 124*a*, $y_2(n)$ 124*b* and $y_P(n)$ 124*c*. For example, the acoustic echo canceller 102*a* may convolve the reference signals 112 with the estimated transfer functions 122 (e.g., estimated impulse responses of the room 10) to generate the estimated echo signals 124. Thus, the acoustic echo canceller 102*a* may convolve the first reference signal 112*a* by the first estimated transfer function 122*a* to generate the first estimated echo signal 124*a*, which models a first portion of the echo signal $y_1(n)$ 120*a*, may convolve the second reference signal 112*b* by the second estimated transfer function 122*b* to generate the second estimated echo signal 124*b*, which models a second portion of the echo signal $y_1(n)$ 120*a*, and may convolve the third reference signal 112*c* by the third estimated transfer function 122*c* to generate the third estimated echo signal 124*c*, which models a third portion of the echo signal $y_1(n)$ 120*a*. The acoustic echo canceller 102*a* may determine the estimated echo signals 124 using adaptive filters, as discussed in greater detail below. For example, the adaptive filters may be normalized least means squared (NLMS) finite impulse response (FIR) adaptive filters that adaptively filter the reference signals 112 using filter coefficients.

The estimated echo signals 124 (e.g., 124*a*, 124*b* and 124*c*) may be combined to generate an estimated echo signal $\hat{y}_1(n)$ 125*a* corresponding to an estimate of the echo component in the echo signal $y_1(n)$ 120*a*. The estimated echo signal can be expressed as:

$$\hat{y}_1(n)=\hat{h}_1(k)*x_1(n)+\hat{h}_2(n)*x_2(n)+\hat{h}_P(n)*x_P(n) \quad [2]$$

where * again denotes convolution. Subtracting the estimated echo signal 125*a* from the echo signal 120*a* produces the first error signal $e_1(n)$ 126*a*. Specifically:

$$\hat{e}_1(n)=y_1(n)-\hat{y}_1(n) \quad [3]$$

The system 100 may perform acoustic echo cancellation for each microphone 118 (e.g., 118*a* and 118*b*) to generate error signals 126 (e.g., 126*a* and 126*b*). Thus, the first acoustic echo canceller 102*a* corresponds to the first microphone 118*a* and generates a first error signal $e_1(n)$ 126*a*, the second acoustic echo canceller 102*b* corresponds to the second microphone 118*b* and generates a second error signal $e_2(n)$ 126*b*, and so on for each of the microphones 118. The first error signal $e_1(n)$ 126*a* and the second error signal $e_2(n)$ 126*b* (and additional error signals 126 for additional microphones) may be combined as an output (i.e., audio output 128). While FIG. 1 illustrates the first acoustic echo canceller 102*a* and the second acoustic echo canceller 102*b* as discrete components, the disclosure is not limited thereto and the first acoustic echo canceller 102*a* and the second acoustic echo canceller 102*b* may be included as part of a single acoustic echo canceller 102.

The acoustic echo canceller 102*a* calculates frequency domain versions of the estimated transfer functions $\hat{h}_1(n)$ 122*a*, $\hat{h}_2(n)$ 122*b* and $\hat{h}_P(n)$ 122*c* using short term adaptive filter coefficients W(k,r) that are used by adaptive filters. In conventional AEC systems operating in the time domain, the adaptive filter coefficients are derived using least mean squares (LMS), normalized least mean squares (NLMS) or stochastic gradient algorithms, which use an instantaneous estimate of a gradient to update an adaptive weight vector at each time step. With this notation, the LMS algorithm can be iteratively expressed in the usual form:

$$h_{new}=h_{old}+\mu*e*x \quad [4]$$

where $h_{new}$ is an updated transfer function, $h_{old}$ is a transfer function from a prior iteration, μ is the step size between samples, e is an error signal, and x is a reference signal. For example, the first acoustic echo canceller 102*a* may generate the first error signal 126*a* using first filter coefficients for the adaptive filters (corresponding to a previous transfer function $h_{old}$), the step-size controller 104 may use the first error signal 126*a* to determine a step-size value (e.g., μ), and the adaptive filters may use the step-size value to generate second filter coefficients from the first filter coefficients (corresponding to a new transfer function $h_{new}$). Thus, the adjustment between the previous transfer function $h_{old}$ and new transfer function $h_{new}$ is proportional to the step-size value (e.g., μ). If the step-size value is closer to one, the adjustment is larger, whereas if the step-size value is closer to zero, the adjustment is smaller.

Applying such adaptation over time (i.e., over a series of samples), it follows that the error signal "e" (e.g., 126*a*) should eventually converge to zero for a suitable choice of the step size μ (assuming that the sounds captured by the microphone 118*a* correspond to sound entirely based on the references signals 112*a*, 112*b* and 112*c* rather than additional ambient noises, such that the estimated echo signal $\hat{y}_1(n)$ 125*a* cancels out the echo signal $y_1(n)$ 120*a*). However, $e\rightarrow 0$ does not always imply that $h-\hat{h}\rightarrow 0$, where the estimated transfer function $\hat{h}$ cancelling the corresponding actual transfer function h is the goal of the adaptive filter. For example, the estimated transfer functions $\hat{h}$ may cancel a particular string of samples, but is unable to cancel all signals, e.g., if the string of samples has no energy at one or more frequencies. As a result, effective cancellation may be intermittent or transitory. Having the estimated transfer function $\hat{h}$ approximate the actual transfer function h is the goal of single-channel echo cancellation, and becomes even more critical in the case of multichannel echo cancellers that require estimation of multiple transfer functions.

In order to perform acoustic echo cancellation, the time domain input signal y(n) 120 and the time domain reference signal x(n) 112 may be adjusted to remove a propagation delay and align the input signal y(n) 120 with the reference signal x(n) 112. The system 100 may determine the propagation delay using techniques known to one of skill in the art and the input signal y(n) 120 is assumed to be aligned for the purposes of this disclosure. For example, the system 100 may identify a peak value in the reference signal x(n) 112, identify the peak value in the input signal y(n) 120 and may determine a propagation delay based on the peak values.

The acoustic echo canceller(s) 102 may use short-time Fourier transform-based frequency-domain acoustic echo cancellation (STFT AEC) to determine step-size. The following high level description of STFT AEC refers to echo signal y (120) which is a time-domain signal comprising an echo from at least one loudspeaker (114) and is the output of a microphone 118. The reference signal x (112) is a time-domain audio signal that is sent to and output by a loudspeaker (114). The variables X and Y correspond to a Short Time Fourier Transform of x and y respectively, and thus represent frequency-domain signals. A short-time Fourier transform (STFT) is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "m" is a frequency index.

Figure 2A:
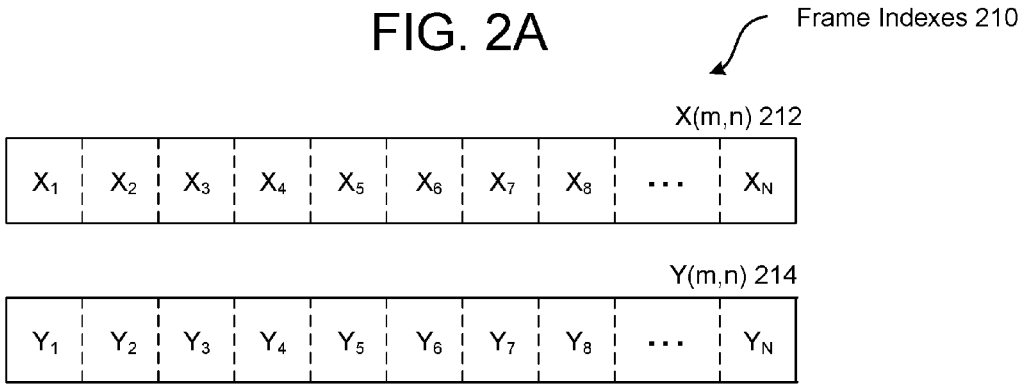
FIGS. 2A to 2C illustrate examples of channel indexes, tone indexes and frame indexes.

FIG. 2A illustrates an example of frame indexes 210 including reference values X(m,n) 212 and input values Y(m,n) 214. For example, the AEC 102 may apply a short-time Fourier transform (STFT) to the time-domain reference signal x(n) 112, producing the frequency-domain reference values X(m,n) 212, where the tone index "m" ranges from 0 to M and "n" is a frame index ranging from 0 to N. The AEC 102 may also apply an STFT to the time domain signal y(n) 120, producing frequency-domain input values Y(m,n) 214. As illustrated in FIG. 2A, the history of the values across iterations is provided by the frame index "n", which ranges from 1 to N and represents a series of samples over time.

Figure 2B:
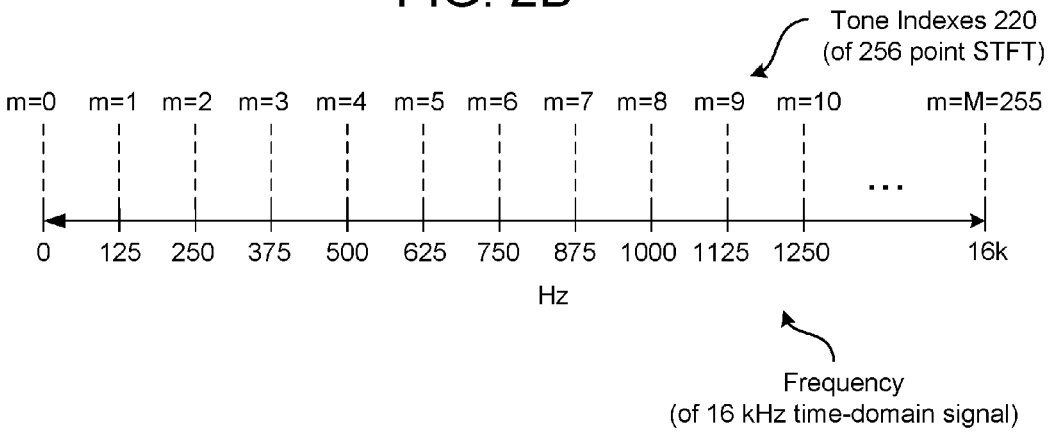
Figure 2C:
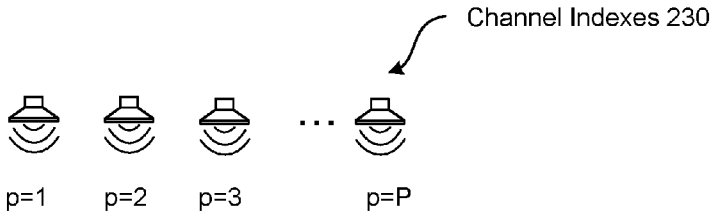

FIG. 2B illustrates an example of performing an M-point STFT on a time-domain signal. As illustrated in FIG. 2B, if a 256-point STFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point STFT corresponds to a frequency range (e.g., subband) in the 16 kHz time-domain signal. While FIG. 2B illustrates the frequency range being divided into 256 different subbands (e.g., tone indexes), the disclosure is not limited thereto and the system 100 may divide the frequency range into M different subbands. While FIG. 2B illustrates the tone index 220 being generated using a Short-Time Fourier Transform (STFT), the disclosure is not limited thereto. Instead, the tone index 220 may be generated using Fast Fourier Transform (FFT), generalized Discrete Fourier Transform (DFT) and/or other transforms known to one of skill in the art (e.g., discrete cosine transform, non-uniform filter bank, etc.).

Given a signal z[n], the STFT Z(m,n) of z[n] is defined by $$Z(m,n)=\sum_{k=0}^{K-1} Win(k)*z(k+n*\mu)*e^{-2pi*m*k/K} \quad [5.1]$$

Where, Win(k) is a window function for analysis, m is a frequency index, n is a frame index, μ is a step-size (e.g., hop size), and K is an FFT size. Hence, for each block (at frame index n) of K samples, the STFT is performed which produces K complex tones X(m,n) corresponding to frequency index m and frame index n.

Referring to the input signal y(n) 120 from the microphone 118, Y(m,n) has a frequency domain STFT representation:

$$Y(m,n)=\sum_{k=0}^{K-1} Win(k)*y(k+n*\mu)*e^{-2pi*m*k/K} \quad [5.2]$$

Referring to the reference signal x(n) 112 to the loudspeaker 114, X(m,n) has a frequency domain STFT representation:

$$X(m,n)=\sum_{k=0}^{K-1} Win(k)*y(k+n*\mu)*e^{-2pi*m*k/K} \quad [5.3]$$

The system 100 may determine the number of tone indexes 220 and the step-size controller 104 may determine a step-size value for each tone index 220 (e.g., subband). Thus, the frequency-domain reference values X(m,n) 212 and the frequency-domain input values Y(m,n) 214 are used to determine individual step-size parameters for each tone index "m," generating individual step-size values on a frame-by-frame basis. For example, for a first frame index "1," the step-size controller 104 may determine a first step-size parameter μ(m) for a first tone index "m," a second step-size parameter μ(m+1) for a second tone index "m+1," a third step-size parameter μ(m+2) for a third tone index "m+2" and so on. The step-size controller 104 may determine updated step-size parameters for a second frame index "2," a third frame index "3," and so on.

As illustrated in FIG. 1, the system 100 may be a multi-channel AEC, with a first channel p (e.g., reference signal 112*a*) corresponding to a first loudspeaker 114*a*, a second channel (p+1) (e.g., reference signal 112*b*) corresponding to a second loudspeaker 114*b*, and so on until a final channel (P) (e.g., reference signal 112*c*) that corresponds to loudspeaker 114*c*. FIG. 2A illustrates channel indexes 230 including a plurality of channels from channel p to channel P. Thus, while FIG. 1 illustrates three channels (e.g., reference signals 112), the disclosure is not limited thereto and the number of channels may vary. For the purposes of discussion, an example of system 100 includes "P" loudspeakers 114 (P>1) and a separate microphone array system (microphones 118) for hands free near-end/far-end multichannel AEC applications.

For each channel of the channel indexes (e.g., for each loudspeaker 114), the step-size controller 104 may perform the steps discussed above to determine a step-size value for each tone index 220 on a frame-by-frame basis. Thus, a first reference frame index 210*a* and a first input frame index 214*a* corresponding to a first channel may be used to determine a first plurality of step-size values, a second reference frame index 210*b* and a second input frame index 214*b* corresponding to a second channel may be used to determine a second plurality of step-size values, and so on. The step-size controller 104 may provide the step-size values to adaptive filters for updating filter coefficients used to perform the acoustic echo cancellation (AEC). For example, the first plurality of step-size values may be provided to first AEC 102*a*, the second plurality of step-size values may be provided to second AEC 102*b*, and so on. The first AEC 102*a* may use the first plurality of step-size values to update filter coefficients from previous filter coefficients, as discussed above with regard to Equation 4. For example, an adjustment between the previous transfer function $h_{old}$ and new transfer function $h_{new}$ is proportional to the step-size value (e.g., μ). If the step-size value is closer to one, the adjustment is larger, whereas if the step-size value is closer to zero, the adjustment is smaller.

Calculating the step-size values for each channel/tone index/frame index allows the system 100 to improve steady-state error, reduce a sensitivity to local speech disturbance and improve a convergence rate of the AEC 102. For example, the step-size value may be increased when the error signal 126 increases (e.g., the echo signal 120 and the estimated echo signal 125 diverge) to increase a convergence rate and reduce a convergence period. Similarly, the step-size value may be decreased when the error signal 126 decreases (e.g., the echo signal 120 and the estimated echo signal 125 converge) to reduce a rate of change in the transfer functions and therefore more accurately estimate the estimated echo signal 125.

Figure 3:
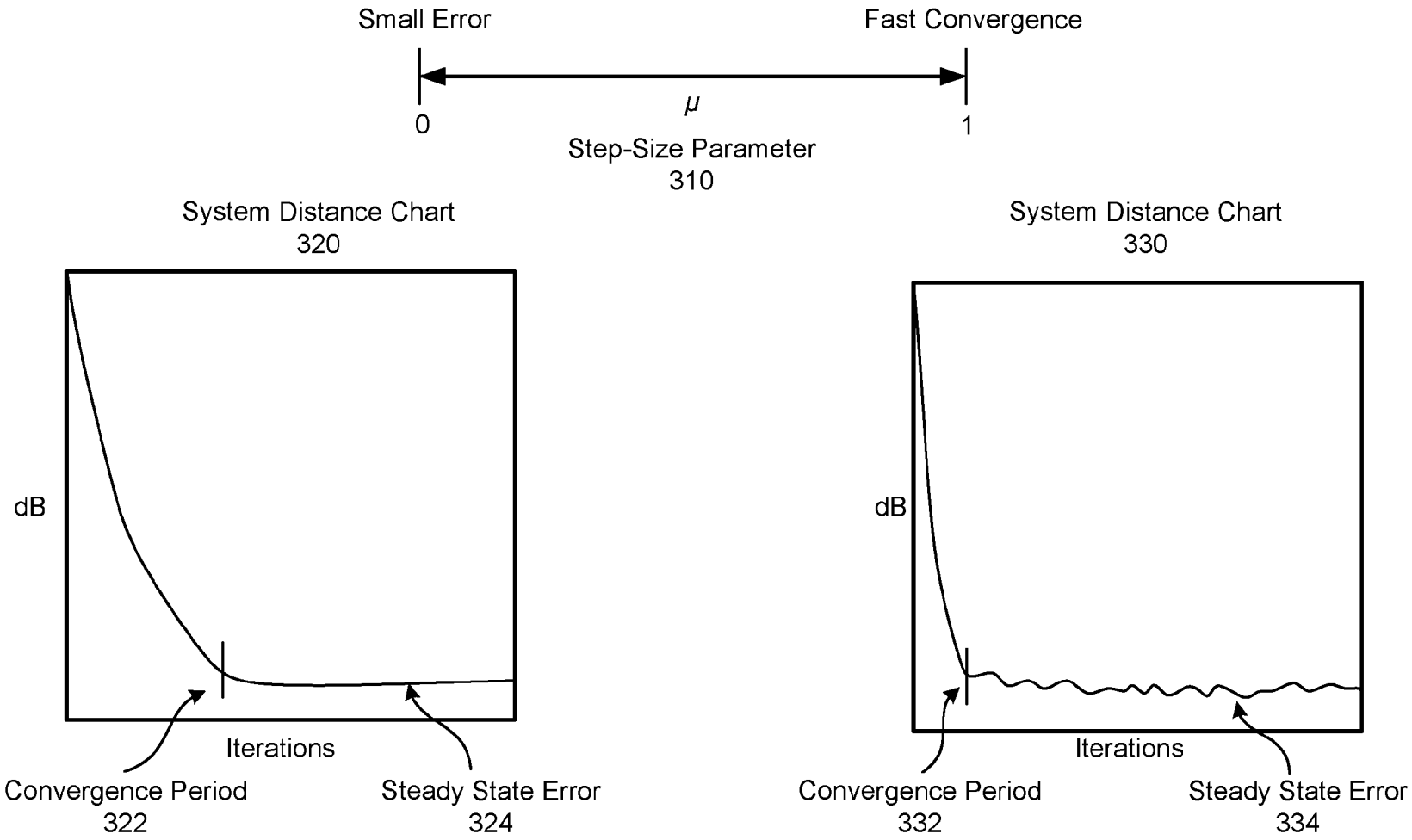
FIG. 3 illustrates examples of convergence periods and steady state error associated with different step-size parameters.

FIG. 3 illustrates examples of convergence periods and steady state error associated with different step-size parameters. As illustrated in FIG. 3, a step-size parameter 310 may vary between a lower bound (e.g., 0) and an upper bound (e.g., 1). A system distance measures the similarity between the estimated impulse response and the true impulse response. Thus, a relatively small step-size value corresponds to system distance chart 320, which has a relatively long convergence period 322 (e.g., time until the estimated echo signal 125 matches the echo signal 120) but relatively low steady state error 324 (e.g., the estimated echo signal 125 accurately estimates the echo signal 120). In contrast, a relatively large step-size value corresponds to system distance chart 330, which has a relatively short convergence period 332 and a relatively large steady state error 334. While the large step-size value quickly matches the estimated echo signal 125 to the echo signal 120, the large step-size value prevents the estimated echo signal 125 from accurately estimating the echo signal 120 over time due to misadjustments caused by noise sensitivity and/or near-end speech (e.g., speech from a speaker in proximity to the microphone 118).

Figure 4:
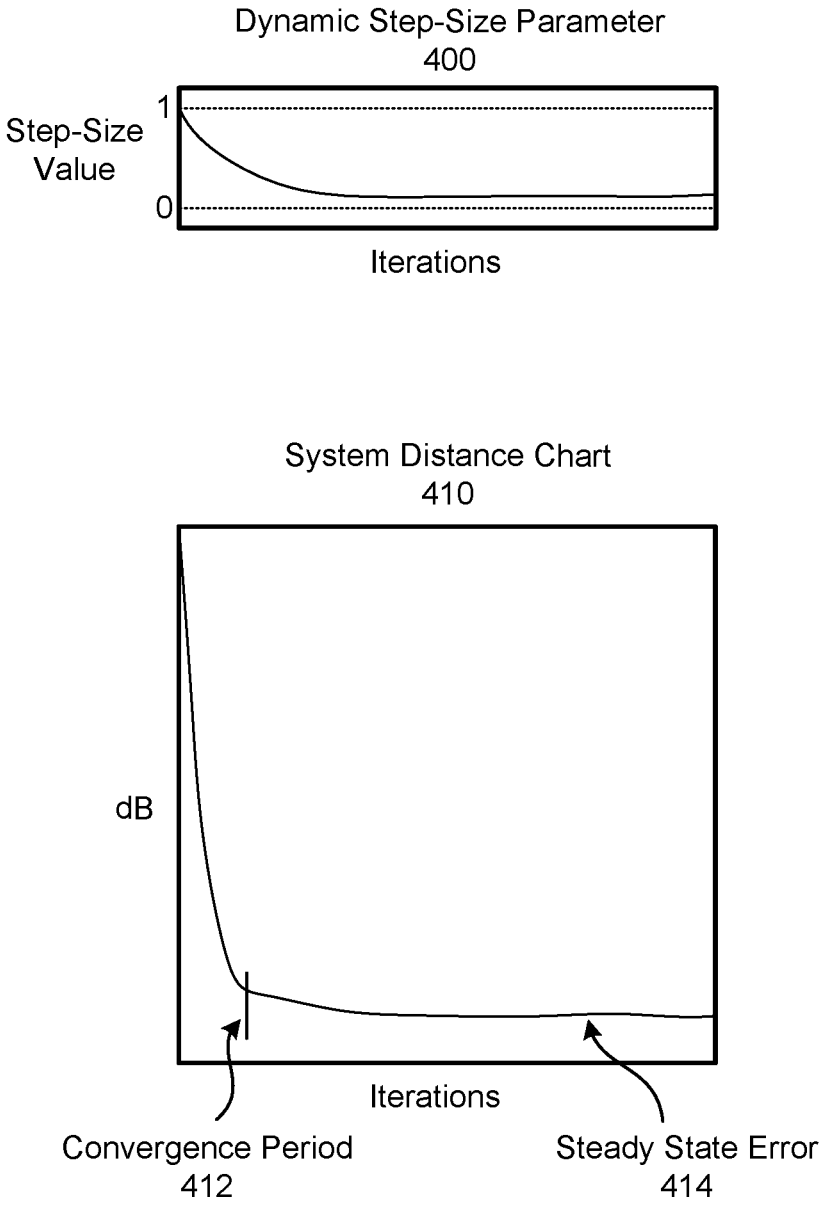
FIG. 4 illustrates an example of a convergence period and steady state error when a step-size parameter is controlled dynamically according to embodiments of the present disclosure.

FIG. 4 illustrates an example of a convergence period and steady state error when a step-size parameter is controlled dynamically according to embodiments of the present disclosure. As illustrated in FIG. 4, the system 100 may control a step-size value of a dynamic step-size parameter 400 over multiple iterations, ranging from an initial step-size value of one to improve convergence rate down to a smaller step-size value to prevent misadjustments. System distance chart 410 illustrates the effect of the dynamic step-size parameter 400, which has a relatively short convergence period 412 and relatively low steady state error 414.

While FIG. 4 illustrates a static environment where the system 100 controls the dynamic step-size parameter 400 from an initial state to a steady-state, a typical environment is dynamic and changes over time. For example, objects in the room 10 may move (e.g., a speaker may step in front of a loudspeaker 114 and/or microphone 118) and change an echo path, ambient noise (e.g., conversation levels, external noises or intermittent noises or the like) in the room 10 may vary and/or near-end speech (e.g., speech from a speaker in proximity to the microphone 118) may be present. The system 100 may dynamically control the step-size parameter to compensate for these fluctuations in environment and/or echo path.

For example, when the system 100 begins performing AEC, the system 100 may control step-size values to be large in order for the system 100 to learn quickly and match the estimated echo signal to the microphone signal. As the system 100 learns the impulse responses and/or transfer functions, the system 100 may reduce the step-size values in order to reduce the error signal and more accurately calculate the estimated echo signal so that the estimated echo signal matches the microphone signal. In the absence of an external signal (e.g., near-end speech), the system 100 may converge so that the estimated echo signal closely matches the microphone signal and the step-size values become very small. If the echo path changes (e.g., someone physically stands between a loudspeaker 114 and a microphone 118), the system 100 may increase the step-size values to learn the new acoustic echo. In the presence of an external signal (e.g., near-end speech), the system 100 may decrease the step-size values so that the estimated echo signal is determined based on previously learned impulse responses and/or transfer functions and the system 100 outputs the near-end speech.

Additionally or alternatively, the step-size values may be distributed in accordance with the reference signals 112. For example, if one channel (e.g., reference signal 112*a*) is significantly louder than the other channels, the system 100 may increase a step-size value associated with the reference signal 112*a* relative to step-size values associated with the remaining reference signals 112. Thus, a first step-size value corresponding to the reference signal 112*a* will be relatively larger than a second step-size value corresponding to the reference signal 112*b*.

Figure 5:
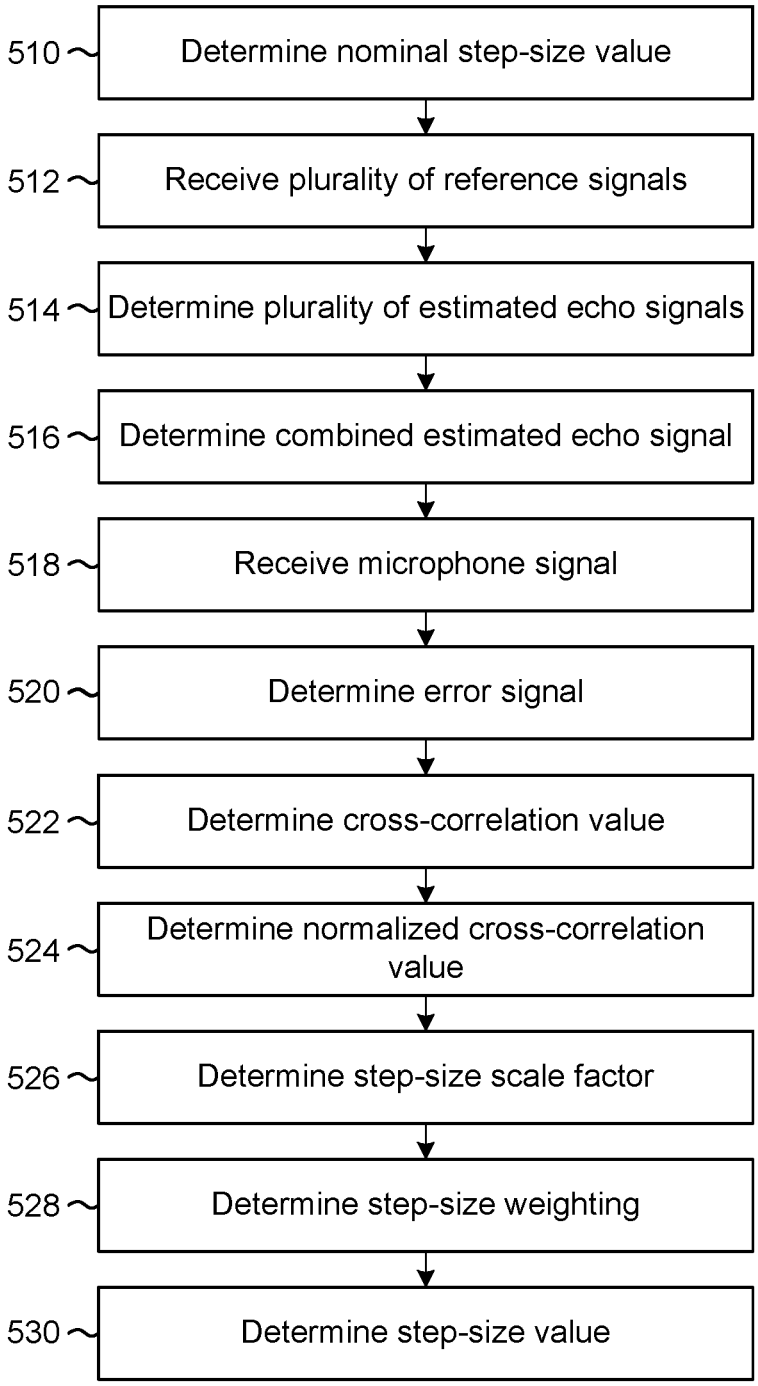
FIG. 5 is a flowchart conceptually illustrating an example method for dynamically controlling a step-size parameter according to embodiments of the present disclosure.

FIG. 5 is a flowchart conceptually illustrating an example method for dynamically controlling a step-size parameter according to embodiments of the present disclosure. The example method illustrated in FIG. 5 determines a step-size value for a single step-size parameter. The step-size parameter for a pth channel (e.g., reference signal 112), an mth tone index (e.g., frequency subband) and an nth sample index (e.g., sample for the first tone index) may be denoted as $\mu_p(m,n)$. The system 100 may repeatedly perform the example method illustrated in FIG. 5 to determine step-size values for each channel and tone index on a frame-by-frame basis.

As illustrated in FIG. 5, the system 100 may determine (510) a nominal step-size value for the pth channel and the mth tone index. A nominal step-size value may be defined for every tone index and/or channel. For example, $\mu_p(m,n)$ denotes a nominal step-size value for the mth tone index (e.g., frequency subband) and the pth channel (e.g., reference signal 120), and, in some examples, may have a value of 0.1 or 0.2. Thus, the nominal step-size values may vary between channels and tone indexes, although the disclosure is not limited thereto and the nominal step-size value may be uniform for all channels and/or tone indexes without departing from the disclosure. For example, a first nominal step-size value may be used for multiple channels at a first tone index (e.g., frequency subband), whereas a second nominal step-size value may be used for multiple channels at a second tone index. Thus, the system 100 may have variations in nominal step-size values between lower tone indexes and higher tone indexes, such as using a larger step-size value for the lower tone indexes (e.g., low frequency range) and a smaller step-size value for the high tone indexes (e.g., high frequency range). The nominal step-size values may be obtained from large data sets and programmed during an initialization phase of the system 100.

The system 100 may receive (512) a plurality of reference signals (e.g., 112*a*/112*b*/112*c*) and may determine (514) a plurality of estimated echo signals (e.g., 124*a*/124*b*/124*c*). For example, $\hat{y}_p(m,n)$ denotes an estimated echo signal of the pth channel for the mth tone index and nth sample. The system 100 may obtain this estimated echo signal $\hat{y}_p(m,n)$ by filtering the reference signal of the pth channel with the adaptive filter coefficients weight vector $w_p(m,n) \triangleq [w_p^0(m,n)\ w_p^1(m,n)\ \ldots\ w_p^{L-1}(m,n)]$:

$$\hat{y}_p(m,n) = \sum_{r=0}^{L-1} x_p(m,n-r) w_p^r(m,n) \quad [6]$$

The system 100 may use the estimated echo signals (e.g., 124*a*/124*b*/124*c*) to determine (516) a combined estimated echo signal (e.g., 125*a*). For example, the system 100 may determine the combined (e.g., multi-channel) echo estimate signal 125 for a given microphone 118 as:

$$\hat{y}(m,n) = \sum_{p=1}^{P} \hat{y}_p(m,n) \quad [7]$$

The system 100 may receive (518) a microphone signal 120 (e.g., 120*a*) and may determine (520) an error signal 126 (e.g., 126*a*) using the combined echo estimate signal 125 (e.g., 125*a*) and the microphone signal 120. For example, the system 100 may determine the error signal 126 as:

$$e(m,n)=y(m,n)-\hat{y}(m,n) \quad [8]$$

where, e(m,n) is the error signal (e.g., error signal 126*a* output by the first AEC 102*a*), y(m,n) is the microphone signal (e.g., 120*a*) and the error signal denotes the difference between the combined echo estimate (e.g., 125*a*) and the microphone signal (e.g., 120*a*).

The system 100 may determine (522) a cross-correlation value between the error signal (e.g., 126*a*) and the estimated echo signal for the pth channel (e.g., 124*a*). For example, the system 100 may determine a cross-correlation (e.g., $r_{e\hat{y}_P}(m,n)$) using a first-order recursive averaging:

$$r_{e\hat{y}_p}(m,n) = \alpha r_{e\hat{y}_p}(m,n-1) + (1-\alpha)\hat{y}_p^*(m,n)e(m,n) \quad [9]$$

where $r_{e\hat{y}_p}(m,n)$ is a current cross-correlation value, $\alpha \in [0, 1.0]$ is a smoothing parameter, $r_{e\hat{y}_p}(m,n-1)$ is a previous cross-correlation value, $\hat{y}_P(m,n)$ is the estimated echo signal 124*a*, and $e(m, n)$ is the error signal 126*a*. The smoothing parameter is a decimal value between zero and one that indicates a priority of previous cross-correlation values relative to current cross-correlation values. For example, a value of one gives full weight to the previous cross-correlation values and no weight to the current cross-correlation values whereas a value of zero gives no weight to the previous cross-correlation values and full weight to the current cross-correlation values. As Equation 9 is a recursive equation, smoothing parameter values between zero and one correspond to various windows of time. For example, a smoothing parameter value of 0.9 may correspond to a time window of 100 ms, whereas a smoothing parameter value of 0.95 may correspond to a time window of 200 ms. Therefore, the system 100 may select the smoothing parameter based on a desired time window to include when determining the current cross-correlation value. The system 100 may set an initial cross-correlation value equal to one, such that $r_{e\hat{y}_P}(m,0)=1.0$.

The system 100 may determine (524) a normalized squared cross-correlation (NSCC) value between the error signal (e.g., 126*a*) and the estimated echo signal (e.g., 124*a*) of the pth channel using the cross-correlation value. For example, the system 100 may determine a NSCC value using:

$$\tilde{r}_{e\hat{y}_p}(m,n) = \left| \frac{r_{e\hat{y}_p}(m,n)}{\sqrt{\sigma_e^2(m,n)\sigma_{\hat{y}_p}^2(m,n) + \varepsilon}} \right|^2 \quad [10]$$

where $\tilde{r}_{e\hat{y}_p}(m,n)$ is the NSCC value, $r_{e\hat{y}_p}(m,n)$ is the cross-correlation value, $\epsilon$ is a regularization factor (e.g., small constant, such as between $10^{-6}$ and $10^{-8}$, that prevents the denominator from being zero), and $\sigma^2_e(m,n)$ and $\sigma^2_{\hat{y}_p}(m,n)$ denote a first power of the error signal (e.g., 126*a*) and a second power of the estimated echo signal (e.g., 124*a*) for the mth tone index and nth sample, respectively, which can be computed using a first-order recursive averaging:

$$\sigma_e^2(m,n) = \alpha\sigma_e^2(m,n-1) + (1-\alpha)|e(m,n)|^2 \quad [11.1]$$

$$\sigma_{\hat{y}_p}^2(m,n) = \alpha\sigma_{\hat{y}_p}^2(m,n-1) + (1-\alpha)|\hat{y}_p(m,n)|^2 \quad [11.2]$$

where $\sigma^2_e(m,n)$ is the current power of the error signal (e.g., 126*a*), $\sigma^2_e(m,n-1)$ is the previous power of the error signal (e.g., 126*a*), $\alpha$ is a smoothing parameter as discussed above, e(m, n) is the error signal 126*a*, $$\sigma_{\hat{y}_p}^2(m,n)$$

is the current power of the estimated echo signal (e.g., 124*a*), $$\sigma_{\hat{y}_p}^2(m,n-1)$$

is the previous power of the estimated echo signal (e.g., 124*a*), and $\hat{y}_p(m,n)$ is the estimated echo signal 124*a*.

The NSCC value effectively divides the cross-correlation value by a square root of variance of the error signal (e.g., 126*a*) and the estimated echo signal (e.g., 124*a*) of the pth channel. By normalizing the cross-correlation value, the NSCC value has similar meanings between different signal conditions (e.g., NSCC value of 0.7 has the same meaning regardless of the signal conditions). In some examples, the system 100 may bound the NSCC value between zero and one, such that $\tilde{r}_{e\hat{y}_p}(m,n) \in [0, 1.0]$. For ease of notation, the (m,n) indices may be dropped as they are assumed to be present in all of the following equations.

The system 100 may determine (526) a step-size scale factor associated with the pth channel, mth tone index and nth sample. For example, the system 100 may determine the step-size scale factor using:

$$\tilde{\mu}_p(m,n) = \frac{\left[\left(1 + k\tilde{r}_{e\hat{y}_p}\right)\sigma_{\hat{y}_p}^2 + \delta\right]}{\left[\sigma_{\hat{y}_p}^2 + \beta\left(1 - \tilde{r}_{e\hat{y}_p}\right)\sigma_e^2 + \delta\right]} \quad [12]$$

where $\hat{\mu}_p(m,n)$ is the step-size scale factor, k is a first tunable parameter, $\tilde{r}_{e\hat{y}_p}$ is the NSCC value, $\sigma^2_{\hat{y}_p}$ is the current power of the estimated echo signal (e.g., 124*a*), $\delta$ is a regularization factor (e.g., small constant, such as between $10^{-6}$ and $10^{-8}$, that prevents the denominator from being zero), $\beta$ is a second tunable parameter, and $\sigma^2_e$ is the current power of the error signal (e.g., 126*a*).

The first tunable parameter k determines how much fluctuation (e.g., difference between maximum and minimum) occurs in the step-size parameter. For example, a value of four allows the step-size value to fluctuate up to five times the nominal step-size value, whereas a value of zero allows the step-size value to fluctuate only up to the nominal step-size value. An appropriate value for the first tunable parameter k is determined based on the system 100 and fixed during an initialization phase of the system 100.

Similarly, the second tunable parameter $\beta$ modulates the step-size value based on near-end speech after the system 100 has converged and the NSCC value $\tilde{r}_{e\hat{y}_p}$ approaches a value of zero. When near-end speech is not present, the error signal 126*a* is a result of the estimated echo signal 125 not properly modeling the echo signal 120*a*, so the system 100 increases the step-size value $\tilde{\mu}_p$ in order to more quickly converge the system 100 (e.g., properly model the echo signal 120*a* so that the error signal 126*a* approaches a value of zero). Thus, when near-end speech is not present, the system 100 improves the acoustic echo cancellation by increasing the step-size value and adjusting the filter coefficients. However, when near-end speech is present, the error signal 126*a* is a result of the near-end speech and the audio output by the system 100 includes the near-end speech. Therefore, the system 100 improves the acoustic echo cancellation by decreasing the step-size value so that the filter coefficients are not adjusted based on the near-end speech. The system 100 accomplishes this using the second tunable parameter $\beta$, which is multiplied by the power $\sigma^2_e$ of the error signal 126*a* and one minus the NSCC value $\tilde{r}_{e\hat{y}_p}$. Thus, when the NSCC value $\tilde{r}_{e\hat{y}_p}$ is approximately one (e.g., the system 100 has not converged), the power $\sigma^2_e$ of the error signal 126*a* is ignored (e.g., multiplied by zero) and the step-size value $\tilde{\mu}_p$ is determined by the first tunable parameter k. For example, Equation 12 simplifies to $\tilde{\mu}_p=(1+k)$ as the power $$\sigma_{\hat{y}_p}^2$$

of the estimated echo signal 124*a* cancels out (e.g., $$\sigma_{\hat{y}_p}^2 / \sigma_{\hat{y}_p}^2 = 1).$$

However, when the NSCC value $\tilde{r}_{e\hat{y}_p}$ approaches zero (e.g., the system 100 is converging), the power $\sigma^2_e$ of the error signal 126*a* is multiplied by the second tunable parameter $\beta$ and the step-size value $\tilde{\mu}_p$ is decreased accordingly. For example, Equation 12 simplifies to $$\tilde{\mu}_p = \sigma_{\hat{y}_p}^2 / \left(\sigma_{\hat{y}_p}^2 + \beta\sigma_e^2\right).$$

The system 100 may determine (528) a step-size weighting associated with the pth channel, mth tone index and nth sample. For example, the system 100 may determine the step-size weighting as:

$$\lambda_p = \frac{\sigma_{x_p}^2}{\max_p\{\sigma_{x_p}^2\}} \quad [13]$$

where $\lambda_p$ is the step-size weight, $$\sigma_{x_p}^2$$

is the power of the reference signal 112, and $$\max_p\{\sigma_{x_p}^2\}$$

is a maximum power for every reference signal 112. To illustrate, if there are three reference signals (e.g., 112*a*, 112*b*, 112*c*), then $$\max_p\{\sigma_{x_p}^2\}$$

is the maximum power (e.g., reference signal 112 with the highest power). For example, if reference signal 112*a* has the highest power, then $$\lambda_1 = \sigma_{x_1}^2 / \sigma_{x_1}^2,$$

$$\lambda_2 = \sigma_{x_2}^2 / \sigma_{x_1}^2,$$

and $$\lambda_3 = \sigma_{x_3}^2 / \sigma_{x_1}^2.$$

Thus, the step-size weighting is calculated based on a signal strength and corresponds to a magnitude of the reference signal relative to a maximum magnitude. The step-size weight may be determined for each tone index (e.g., frequency subband), such that a first step-size weight corresponding to a first tone index (e.g., low frequency subband) is based on the maximum power for portions of every reference signal 112 in the low frequency subband while a second step-size weight corresponding to a second tone index (e.g., high frequency subband) is based on the maximum power for portions of every reference signal 112 in the high frequency subband.

For example, if one channel (e.g., reference signal 112*a*) is significantly louder than the other channels, the system 100 may increase the step-size weighting to increase a step-size value associated with the reference signal 112*a* relative to step-size values associated with the remaining reference signals 112. Thus, a first step-size value corresponding to the reference signal 112*a* will be relatively larger than a second step-size value corresponding to the reference signal 112*b*. In some examples, the system 100 may bound the fractional step-size weighting between an upper bound and a lower bound, although the disclosure is not limited thereto and the step-size weighting may vary between zero and one.

The system 100 may determine (530) a step-size value based on the step-size scale factor, the step-size weighting and the nominal step-size value. For example, the step-size value of the pth channel for the mth tone index (e.g., frequency subband) and nth sample may be determined using:

$$\mu_p(m,n)=\lambda_p(m,n)\tilde{\mu}_p(m,n)\mu_{o,p}{}^m \quad [14]$$

where $\mu_p(m, n)$ is a, $\tilde{\mu}_p(m, n)$ is the step-size scale factor, a, $\mu^m{}_{o,p}(m, n)$ denotes a nominal step-size value for the mth tone index (e.g., frequency subband) and the pth channel (e.g., reference signal 120).

The system 100 may repeat the example method illustrated in FIG. 5 to determine step-size values for each of the P channels and M tone indexes on a frame-by-frame basis and may continue to provide the step-size values to the AEC 102 over time. In addition, the system 100 may repeat the example method illustrated in FIG. 5 separately for each AEC 102 (e.g., 102*a*, 102*b*).

Initially, when the algorithm has just started, the NSCC value is approximately one (e.g., $\tilde{r}_{e\hat{y}_p}(m,0)\approx 1)$). Thus, the step-size scale factor is approximately $\tilde{\mu}_p(m, n)\approx(1+k)$ and therefore the step-size value is approximately $\tilde{\mu}_p(m, n)\approx\lambda_p(m,n)(1+k)\mu_{o,p}{}^m$, resulting in a large step-size value to adapt to the environment with a fast convergence rate. Later, as the system 100 has converged (e.g., the combined estimated echo signal 125*a* matches the echo signal 120*a*), the NSCC value is approximately zero (e.g., $\tilde{r}_{e\hat{y}_p}(m,n)\approx 0$). Thus, the step-size value is approximately $$\mu_p(m, n) \approx \lambda_p(m, n)\frac{\sigma_{\hat{y}_p}^2}{\sigma_{\hat{y}_p}^2 + \beta\sigma_e^2}\mu_{o,p}^m,$$

meaning that the step-size value $\mu_p(m,n)$ is largely controlled by the relative powers of the estimated echo signal 125*a* (e.g., $$\sigma_{\hat{y}_p}^2)$$

and the error signal 126*a* (e.g., $\sigma^2{}_e$). Therefore, if the external disturbance is large, the error signal energy (e.g., $\sigma^2{}_e$) increases and the step-size value $\mu_p(m,n)$ is reduced proportionately in order to protect the AEC weights from divergence. For example, when the system 100 detects near-end speech, the error becomes high due to the external disturbance, which cannot be cancelled and is therefore represented in the error signal. Thus, the denominator becomes large and the step-size value $\mu_p(m,n)$ becomes small.

When the echo path changes, the NSCC value begins to increase towards a value of one, resulting in the step-size value $\mu_p(m,n)$ increasing, enabling the AEC 102 to converge quickly (e.g., the combined estimated echo signal 125*a* matches the microphone signal 120*a* in a short amount of time).

The system 100 may use the step-size value $\mu_p(m,n)$ to update the weight vector in Equation 6 according to a tone index normalized least mean squares algorithm:

$$\underline{w}_p(m, n) = \underline{w}_p * (m, n-1) + \frac{\mu_p(m, n)}{\|\underline{x}_p(m, n)\|^2 + \xi} \underline{x}_p(m, n) e(m, n) \quad [15]$$

where w(m,n) is an updated weight vector, w(m, n−1) is a weight vector from a prior iteration, μ(m, n) is the step size between samples (e.g., step-size value), ç is a regularization factor, x(m, n) is a reference signal (e.g., reference signal 112) and e(m, n) is an error signal (e.g., error signal 126*a*).

Equation 15 is similar to Equation 4 discussed above with regard to determining an updated transfer function, but Equation 15 normalizes the updated weight by dividing the step-size value μ(m, n) by a sum of a regularization factor ç and a square of the absolute value of the reference signal x(m, n). The regularization factor ç is a small constant (e.g., between $10^{-6}$ to $10^{-8}$) that ensures that the denominator is a value greater than zero. Thus, the adjustment between the previous weight vector w(m, n−1) and the updated weight vector w(m, n) is proportional to the step-size value μ(m, n). If the step-size value μ(m, n) is closer to one, the adjustment is larger, whereas if the step-size value μ(m, n) is closer to zero, the adjustment is smaller.

Figure 6:
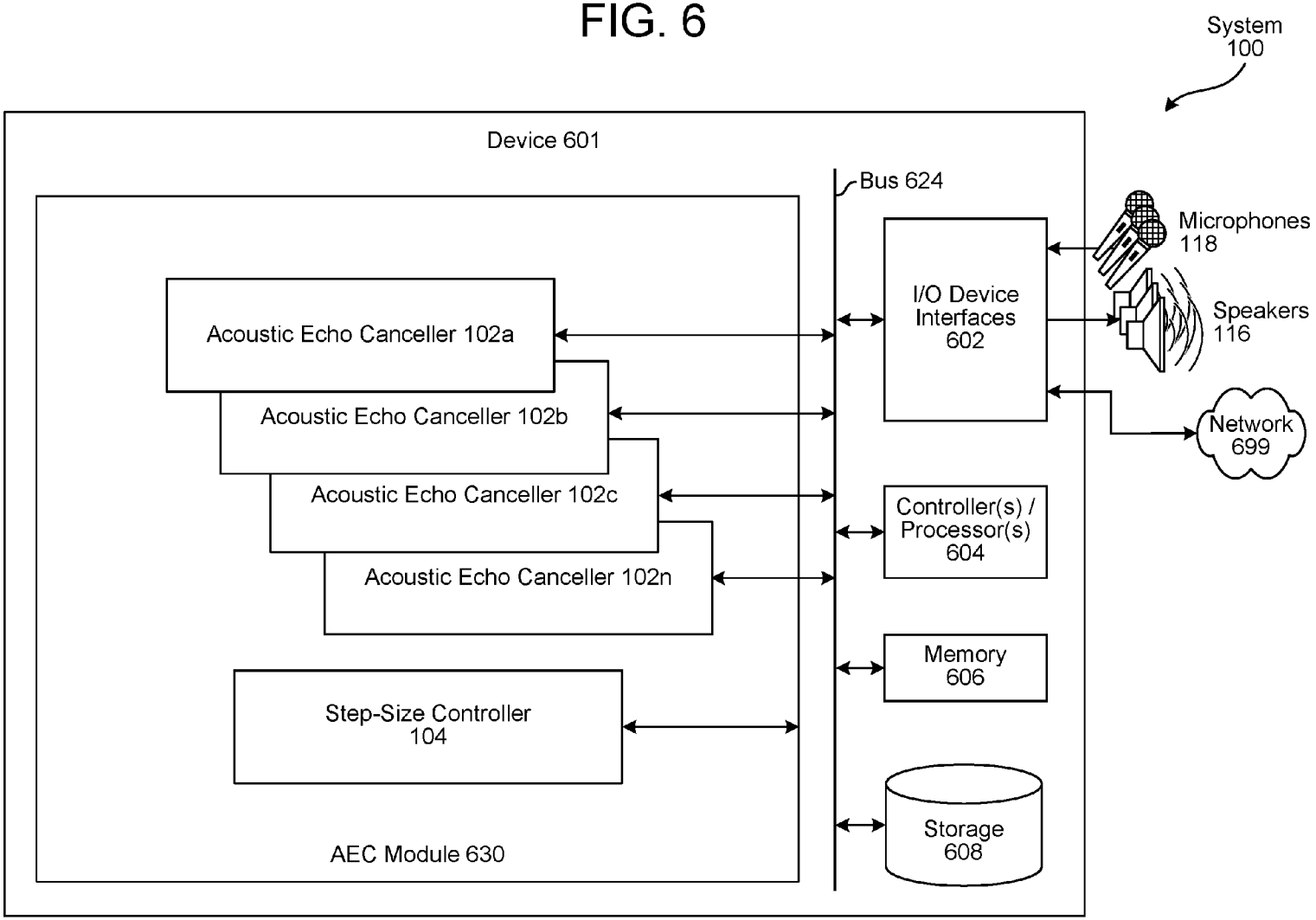
FIG. 6 is a block diagram conceptually illustrating example components of a system for echo cancellation according to embodiments of the present disclosure.

FIG. 6 is a block diagram conceptually illustrating example components of the system 100. In operation, the system 100 may include computer-readable and computer-executable instructions that reside on the device 601, as will be discussed further below.

The system 100 may include one or more audio capture device(s), such as a microphone 118 or an array of microphones 118. The audio capture device(s) may be integrated into the device 601 or may be separate.

The system 100 may also include an audio output device for producing sound, such as speaker(s) 114. The audio output device may be integrated into the device 601 or may be separate.

The device 601 may include an address/data bus 624 for conveying data among components of the device 601. Each component within the device 601 may also be directly connected to other components in addition to (or instead of) being connected to other components across the bus 624.

The device 601 may include one or more controllers/processors 604, that may each include a central processing unit (CPU) for processing data and computer-readable instructions, and a memory 606 for storing data and instructions. The memory 606 may include volatile random access memory (RAM), non-volatile read only memory (ROM), non-volatile magnetoresistive (MRAM) and/or other types of memory. The device 601 may also include a data storage component 608, for storing data and controller/processor-executable instructions (e.g., instructions to perform the algorithms illustrated in FIGS. 1, 5 and/or XXE). The data storage component 608 may include one or more non-volatile storage types such as magnetic storage, optical storage, solid-state storage, etc. The device 601 may also be connected to removable or external non-volatile memory and/or storage (such as a removable memory card, memory key drive, networked storage, etc.) through the input/output device interfaces 602.

Computer instructions for operating the device 601 and its various components may be executed by the controller(s)/processor(s) 604, using the memory 606 as temporary "working" storage at runtime. The computer instructions may be stored in a non-transitory manner in non-volatile memory 606, storage 608, or an external device. Alternatively, some or all of the executable instructions may be embedded in hardware or firmware in addition to or instead of software.

The device 601 includes input/output device interfaces 602. A variety of components may be connected through the input/output device interfaces 602, such as the speaker(s) 114, the microphones 118, and a media source such as a digital media player (not illustrated). The input/output interfaces 602 may include A/D converters (not shown) for converting the output of microphone 118 into signals y 120, if the microphones 118 are integrated with or hardwired directly to device 601. If the microphones 118 are independent, the A/D converters will be included with the microphones, and may be clocked independent of the clocking of the device 601. Likewise, the input/output interfaces 602 may include D/A converters (not shown) for converting the reference signals x 112 into an analog current to drive the speakers 114, if the speakers 114 are integrated with or hardwired to the device 601. However, if the speakers are independent, the D/A converters will be included with the speakers, and may be clocked independent of the clocking of the device 601 (e.g., conventional Bluetooth speakers).

The input/output device interfaces 602 may also include an interface for an external peripheral device connection such as universal serial bus (USB), FireWire, Thunderbolt or other connection protocol. The input/output device interfaces 602 may also include a connection to one or more networks 699 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 699, the system 100 may be distributed across a networked environment.

The device 601 further includes an AEC module 630 that includes the individual AEC 102, where there is an AEC 102 for each microphone 118.

Multiple devices 601 may be employed in a single system 100. In such a multi-device system, each of the devices 601 may include different components for performing different aspects of the STFT AEC process. The multiple devices may include overlapping components. The components of device 601 as illustrated in FIG. 6 is exemplary, and may be a stand-alone device or may be included, in whole or in part, as a component of a larger device or system. For example, in certain system configurations, one device may transmit and receive the audio data, another device may perform AEC, and yet another device my use the error signals 126 for operations such as speech recognition.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the AEC module 630 may be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method implemented on a voice-controllable device, the method determining a step-size value of a first adaptive filter of the device, the method comprising:

receiving a first reference audio signal that is sent from the device to a first loudspeaker for audio playback;

receiving, from a microphone of the device, a first microphone audio signal representing audible sound output by the first loudspeaker;

determining, using the first reference audio signal and the first adaptive filter that is configured to adjust according to an optimization algorithm, a first echo audio signal that is an estimated representation of a portion of the first microphone audio signal;

determining a plurality of echo audio signals;

determining a combined echo audio signal by summing the plurality of echo audio signals and the first echo audio signal;

determining an error signal by subtracting the combined echo audio signal from the first microphone audio signal;

determining a first normalized squared cross-correlation (NSCC) value between the error signal and the first echo audio signal;

determining a first scale factor using the first NSCC value, the first scale factor becoming larger as the first NSCC value approaches a value of one;

determining a first weight corresponding to a magnitude of the first reference audio signal;

determining the step-size value by multiplying the first scale factor, the first weight and a nominal step-size value, the step-size value corresponding to the first reference audio signal; and providing the step-size value to the first adaptive filter.

2. The computer-implemented method of claim 1, wherein determining the first scale factor further comprises:

determining a first power value corresponding to the first echo audio signal;

determining second power value corresponding to the error signal;

determining a first product by multiplying one plus the first NSCC value by the first power value;

determining a second product by multiplying one minus the first NSCC value by the second power value;

determining a first sum by adding the first power value to the second product; and determining the first scale factor by dividing the first product by the first sum.

3. The computer-implemented method of claim 1, wherein determining the first NSCC value further comprises:

determining a first smoothing value between zero and one, the first smoothing value indicating a weight associated with a first cross-correlation value at a first time;

determining a second smoothing value by subtracting the first smoothing value from one;

determining the first cross-correlation value between the error signal and the first echo audio signal at the first time;

generating a first product by multiplying the first smoothing value and the first cross-correlation value;

generating a second product by multiplying the second smoothing value, the first echo audio signal and the error signal;

determining a second cross-correlation value between the error signal and the first echo audio signal at a second time after the first time by summing the first product and the second product; and determining the first normalized cross-correlation value by normalizing the second cross-correlation value.

4. The computer-implemented method of claim 1, wherein determining the first weight further comprises:

determining a first portion of the first reference audio signal that corresponds to a first duration of time and a first frequency range;

determining a first portion of the second reference audio signal that corresponds to the first duration of time and the first frequency range;

determining a first power value corresponding to a magnitude of the first portion of the first reference audio signal;

determining a second power value corresponding to a magnitude of the first portion of the second reference audio signal;

determining that the second power value is greater than the first power value; and determining the first weight by dividing the first power value by the second power value.

5. A computer-implemented method, comprising:

receiving a first reference signal corresponding to a first audio channel;

receiving a second reference signal corresponding to a second audio channel;

receiving a first audio input signal;

determining, using a first adaptive filter and the first reference signal, a first echo signal that models a first portion of the first audio input signal;

determining, using a second adaptive filter and the second reference signal, a second echo signal that models a second portion of the first audio input signal;

combining the first echo signal and the second echo signal to generate a combined echo signal;

determining an error signal by subtracting the combined echo signal from the first audio input signal;

determining a first normalized squared cross-correlation (NSCC) value associated with the error signal and the first echo signal;

determining a first scale factor based on the first NSCC value; and determining a first step-size value based on the first scale factor and a nominal step-size value, the first step-size value corresponding to the first reference signal.

6. The computer-implemented method of claim 5, wherein the first step-size value corresponds to the first reference signal, a first duration of time, and a first frequency range, and the method further comprises:

determining a second step-size value, the second step-size value corresponding to the first reference signal, the first duration of time and a second frequency range;

determining a third step-size value, the third step-size value corresponding to the second reference signal, the first duration of time and the first frequency range;

sending the first step-size value to the first adaptive filter;

sending the second step-size value to the first adaptive filter;

sending the third step-size value to the second adaptive filter; and performing acoustic echo cancellation using the first adaptive filter and the second adaptive filter.

7. The computer-implemented method of claim 5, wherein determining the first scale factor further comprises:

determining a first power value corresponding to the first echo signal;

determining second power value corresponding to the error signal;

determining a first product by multiplying the first NSCC value by a first constant;

determining a second product by multiplying one plus the first product by the first power value;

determining a third product by multiplying one minus the first NSCC value by the second power value;

determining a first sum by adding the first power value to the third product; and determining the first scale factor by dividing the second product by the first sum.

8. The computer-implemented method of claim 5, wherein determining the first NSCC value further comprises:

determining a first smoothing value between zero and one, the first smoothing value indicating a weight associated with a first cross-correlation value that corresponds to a first time;

determining a second smoothing value by subtracting the first smoothing value from one;

determining the first cross-correlation value between the error signal and the first echo signal at the first time, the first cross-correlation value corresponding to a second frame preceding the first frame;

generating a first product by multiplying the first smoothing value and the first cross-correlation value;

generating a second product by multiplying the second smoothing value, the first echo signal and the error signal;

determining a second cross-correlation value between the error signal and the first echo signal at a second time after the first time by summing the first product and the second product; and determining the first NSCC value by normalizing the second cross-correlation value.

9. The computer-implemented method of claim 8, wherein determining the first NSCC value further comprises:

determining a first power value corresponding to the first echo signal;

determining a second power value corresponding to the error signal;

determining a third product by multiplying the first power value by the second power value;

determining a first denominator by taking a square root of the third product;

determining a first value by dividing the second cross-correlation value by the denominator; and determining the first NSCC value by squaring a magnitude of the first value.

10. The computer-implemented method of claim 5, further comprising:

determining a first weight corresponding to a magnitude of the first reference signal; and determining the first step-size value based on the first scale factor, the first weight and the nominal step-size.

11. The computer-implemented method of claim 10, wherein determining the first weight further comprises:

determining a first portion of the first reference signal that corresponds to a first duration of time and a first frequency range;

determining a first portion of the second reference signal that corresponds to the first duration of time and the first frequency range;

determining a first power value corresponding to a magnitude of the first portion of the first reference signal;

determining a second power value corresponding to a magnitude of the first portion of the second reference signal;

determining that the second power value is greater than the first power value; and determining the first weight by dividing the first power value by the second power value.

12. The computer-implemented method of claim 5, wherein determining the first echo signal further comprises:

estimating a first transfer function corresponding to an impulse response;

determining a weight vector based on the first transfer function, the weight vector corresponding to adaptive filter coefficients; and determining the first echo signal by convolving the first reference signal with the weight vector.

13. A first device, comprising:

at least one processor;

a wireless transceiver; and a memory device including first instructions operable to be executed by the at least one processor to configure the first device to:

receive a first reference signal corresponding to a first audio channel;

receive a second reference signal corresponding to a second audio channel;

receive a first input signal;

determine, using a first adaptive filter and the first reference signal, a first echo signal that models a first portion of the first audio input signal;

determine, using a second adaptive filter and the second reference signal, a second echo signal that models a second portion of the first audio input signal;

combining the first echo signal and the second echo signal to generate a combined echo signal;

determine an error signal by subtracting the combined echo signal from the first audio input signal;

determine a first normalized squared cross-correlation (NSCC) value associated with the error signal and the first echo signal;

determine a first scale factor based on the first NSCC value; and determine a first step-size value based on the first scale factor and a nominal step-size value, the first step-size value corresponding to the first reference signal.

14. The first device of claim 13, wherein the first step-size value corresponds to the first reference signal, a first duration of time and a first frequency range, and the second instructions further configure the first device to:

determine a second step-size value, the second step-size value corresponding to the first reference signal, the first duration of time and a second frequency range;

determine a third step-size value, the third step-size value corresponding to the second reference signal, the first duration of time and the first frequency range;

send the first step-size value to the first adaptive filter;

send the second step-size value to the first adaptive filter;

send the third step-size value to the second adaptive filter; and perform acoustic echo cancellation using the first adaptive filter and the second adaptive filter.

15. The first device of claim 13, wherein the second instructions further configure the first device to:

determine a first power value corresponding to the first echo signal;

determine second power value corresponding to the error signal;

determine a first product by multiplying the first NSCC value by a first constant;

determine a second product by multiplying one plus the first product by the first power value;

determine a third product by multiplying one minus the first NSCC value by the second power value;

determine a first sum by adding the first power value to the third product; and determine the first scale factor by dividing the second product by the first sum.

16. The first device of claim 13, wherein the second instructions further configure the first device to:

determine a first smoothing value between zero and one, the first smoothing value indicating a weight associated with a first cross-correlation value that corresponds to a first time;

determine a second smoothing value by subtracting the first smoothing value from one;

determine the first cross-correlation value between the error signal and the first echo signal at the first time, the first cross-correlation value corresponding to a second frame preceding the first frame;

generate a first product by multiplying the first smoothing value and the first cross-correlation value;

generate a second product by multiplying the second smoothing value, the first echo signal and the error signal;

determine a second cross-correlation value between the error signal and the first echo signal at a second time after the first time by summing the first product and the second product; and determine the first NSCC value by normalizing the second cross-correlation value.

17. The first device of claim 16, wherein the second instructions further configure the first device to:

determine a first power value corresponding to the first echo signal;

determine a second power value corresponding to the error signal;

determine a third product by multiplying the first power value by the second power value;

determine a first denominator by taking a square root of the third product;

determine a first value by dividing the second cross-correlation value by the denominator; and determine the first NSCC value by squaring a magnitude of the first value.

18. The first device of claim 13, wherein the second instructions further configure the first device to:

determine a first weight corresponding to a magnitude of the first reference signal; and determine the first step-size value based on the first scale factor, the first weight and the nominal step-size.

19. The first device of claim 18, wherein the second instructions further configure the first device to:

determine a first portion of the first reference signal that corresponds to a first duration of time and a first frequency range;

determine a first portion of the second reference signal that corresponds to the first duration of time and the first frequency range;

determine a first power value corresponding to a magnitude of the first portion of the first reference signal;

determine a second power value corresponding to a magnitude of the first portion of the second reference signal;

determine that the second power value is greater than the first power value; and determine the first weight by dividing the first power value by the second power value.

20. The first device of claim 13, wherein the second instructions further configure the first device to:

estimate a first transfer function corresponding to an impulse response;

determine a weight vector based on the first transfer function, the weight vector corresponding to adaptive filter coefficients; and determine the first echo signal by convolving the first reference signal with the weight vector.

* * * * *